United States Patent [19]

Fisher

[11] 3,948,654

[45] Apr. 6, 1976

[54] ELECTROPHOTOGRAPHIC PROCESS

[75] Inventor: Donald J. Fisher, Pittsford, N.Y.

[73] Assignee: Xerox Corporation, Stamford, Conn.

[22] Filed: Mar. 25, 1974

[21] Appl. No.: 454,343

[52] U.S. Cl. ..... 96/1 SD; 96/1.4; 252/62.1 P

[51] Int. Cl.[2] ..... G03G 13/24

[58] Field of Search..... 96/1 SD, 1.5, 1.4; 117/111; 252/501, 62.1

[56] References Cited

UNITED STATES PATENTS

| | | | |
|---|---|---|---|
| 3,146,145 | 8/1964 | Kinsella | 96/1.5 |
| 3,251,686 | 5/1966 | Gundlach | 96/1.5 |
| 3,682,689 | 8/1972 | Dueltgen et al. | 96/1 R |

*Primary Examiner*—David Klein
*Assistant Examiner*—John L. Goodrow

[57] ABSTRACT

An improved electrophotographic imaging process is disclosed wherein toner film formation is reduced and cleansability of photoreceptor surfaces is enhanced. The process involves contacting a photoreceptor surface with a material selected from the group consisting of certain perfluoro organic acids or acid derivatives to form a thin film of the material on the surface, and using the thus coated surface in an electrophotographic imaging process.

13 Claims, No Drawings

ELECTROPHOTOGRAPHIC PROCESS

BACKGROUND OF THE INVENTION

This invention relates in general to an electrophotographic imaging process, and more specifically to a method for improving the cleanability of electophotographic imaging surfaces.

The formation and development of images on the surface of photoconductive materials by electrostatic means is well known. The basic xerographic process as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting latent electrostatic image by depositing on the image a finely divided electroscopic material referred to in the art as "toner." The toner will normally be attracted to those areas of the layer which retain a charge, thereby forming a toner image corresponding to the latent electroscopic image. This powder image may then be transferred to a support surface such as paper. The transferred image may subsequently be permanently affixed to the support surface by heat. Other suitable fixing means such as solvent or overcoating treatment may be substituted for the foregoing heat fixing step.

The methods which have been employed to develop images in electrophotographic printing processes are many and varied. They include cascade development, powder cloud development, magnetic brush development and other methods including fur brush development, doner belt development, impression development and liquid spray development. The two methods most frequently employed in commercial office copying machines which make use of reusable electrophotographic insulators are cascade development and magnetic brush development. The toner particles applied to these development processes usually consist of one or more thermoplastic resin binder materials, for example, polystyrene, polymethyl styrene, polymethyl methacrylate, styrene methacrylate copolymers, and like materials, mixed with from about 1–20% by weight of a coloring material such as carbon black or a colored pigment, so that a colored image can be easily heat fused onto a copy sheet.

The transfer of the toner to the paper is by electricial attraction. Electrical transfer is accomplished by placing the paper in contact with the imaged area of the photoconductive insulating layer, charging the paper electrically with the same polarity as that of the latent image, and then stripping the paper from the plate. The charge applied to the paper overcomes the attraction of the latent image for the toner particles and pulls them onto the paper. Another technique for electrostatic transfer utilizes a semiconductive roll. A dc potential of the correct sign and voltage is applied between the roll and the electrode of the reusable electrophotoconductive insulating layer.

Complete transfer of toner from the surface of the reusable photoconductive insulating layer to the paper is not accomplished by these transfer methods. Accordingly, a fraction of the toner remains behind on the surface of the resusable electrophotoconductive insulating layer, and this residual toner must be removed prior to the next imaging cycle using a suitable cleaning device.

Various electrostatic plate cleaning devices such as "brush" cleaning apparatus, the "web" type cleaning apparatus and the "blade" cleaning apparatus are known in the prior art. A typical brush cleaning apparatus is disclosed by L. E. Walkup et al. in U.S. pat. No. 2,832,977. Brush type cleaning means usually comprise one or more rotating brushes, which brush residual powder from the plate into a stream of air which is exhausted through a filering system. A typical web cleaning device is disclosed by W. P. Graff, Jr. et al. in U.S. Pat. No. 3,186,838. As disclosed by Graff, Jr. et al., removal of the residual powder from the plate is effected by passing a web fibrous material over the plate surface. Blade cleaning involves contacting the plate surface with a flexible cleaning blade which wipes residual toner off the surface of the plate. Typical blade cleaning techniques are disclosed in U.S. Pat. Nos. 3,552,850 and 3,635,704.

The sensitivity of the imaging member to abrasion, however, requires that special precautions be exercised during the cleaning phase of the copying cycle. For example, pressure contact between cleaning webs or blades and imaging surfaces must be kept to a minimum to prevent rapid destruction of the imaging surface. Although thick protective coatings would protect the imaging surfaces for longer periods of time, the electrical properties of the photoconductive layer impose certain limitations as to the acceptable maximum thickness of the coating. Since thick protective coatings are normally applied by conventional coating techniques, including the use of a film forming material suspended in a solvent, considerable inconvenience, expense and time is involved in removing the photoreceptor from the machine, preparing the eroded photoreceptor surface for reception of a new coating, applying the new coating, allowing the new coating to dry and reinstalling the newly coated photoreceptor into the machine. Certain extremely thin films, applied to the imaging surface as a pretreatment or in situ during the machine sequence, have been successful; however, the art is constantly on the lookout for improved films or at least practical alternatives. Further, for reasons which are not entirely clear, toner particles are frequently difficult to remove from some photoreceptor coating materials, and toner accumulation causes deterioration of subsequent images formed on the photoreceptor surface in reusable imaging systems. Thus, there is a continuing need for a better system for protecting imaging surfaces, developing electrostatic latent images and removing residual development images.

The most effective approach in overcoming the aforementioned problems has been to incorporate a minor amount of an additive material into the toner or developer mixture used in the electrophotographic process. Some additives facilitate the cleaning of the plate surface by reducing the adhesion of the toner to the plate surface. For example, toner filming is reduced according to the disclosure of British Pat. No. 1,233,869 by using as an electrophotographic developer a composition containing minor amounts of polyethylene or certain fluorine containing polymers. Other additives facilitate cleaning by reducing the frictional forces between the plate surface and a cleaning member. Examples of such additives are fatty acids or fatty acids salts such as are disclosed in U.S. Pat. No. 3,552,850. However, the mere fact that a particular material has known lubricating properties, or is of low free surface energy, does not necessarily mean that it will be effective as a plate cleaning additive. Other characteristics such as effect on triboelectric properties of the developer, tendency to cause agglomeration of the developer, resistance to abrasion, and most significantly, the effect of the additive on image quality, come into play in determining whether or not a particular material has utility in an electrophotographic process.

Accordingly, it is an object of this invention to provide an electrophotographic process whereby toner film formation on photoreceptor surfaces is reduced.

Another object of this invention is to provide a method whereby the frictional forces in an electrophotographic imaging process are reduced between the photoreceptor surface and the cleaning member employed to remove residual toner from said surface.

SUMMARY OF THE INVENTION

These and other objects of the invention are accomplished by contacting a photoreceptor surface with a minor amount of a material selected from the group consisting of certain perfluoro organic acids or acid derivatives having a melting point in excess of about 45°C, such that a thin coating of the material is formed on the photoreceptor surface. Preferred materials are perfluoro monocarboxylic acids having from 8 to 26 carbon atoms, and their salts, amides and alkyl esters; and perfluoro dicarboxylic acids having from 5 to 26 carbon atoms, and their salts, amides and esters. The coating may be formed by any technique, but is peferably simply admixed in the form of finely divided particles with a toner and/or developer material. Improved results in terms of cleaning of photosensitive surfaces are achieved in a cyclic imaging and development process by forming an electrostatic latent image on an imaging surface, developing said latent image by bringing an electrostatic developing mixture containing the material of the present invention as an additive within the influence of said latent image, removing at least a portion of any residual developer from said imaging surface, and repeating the process in sequence at least one additional time. After a few cycles, it is found that effective amounts of the cleaning additive of the present invention have adhered to the photosensitive surface sufficient to reduce toner film formation and significantly reduce frictional forces between the surface of the photoreceptor and cleaning member.

DETAILED DESCRIPTION OF THE INVENTION

Suitable materials useful as cleaning materials according to the present invention are those having a melting point in excess of 45°C. and selected from the following:

a. perfluoro monocarboxylic acids having 8–26 carbon atoms;
b. perfluoro dicarboxylic acids having 5–26 carbon atoms;
c. metal or ammonium salts of (a) or (b);
d. amides of (a) or (b)
e. alkyl esters of (a) or (b)
f. mixtures of two or more of the above.

The generic fomulae corresponding to the above are as follows: (a) is $F(CF_2)_n$ COOH, where $n$ equals 7 or more; (b) is $(CF_2)_m$ $(COOH)_2$, where $m$ equals 3 or more; (c) is $[F(CF_2)_nCOO]_xM$, where $x$ is 1–3 depending on cationic valence and M is an appropriate cation; the amides of formula (d) derived from monocarboxylic acids are $F(CF_2)_n$ $CONH_2$, $F(CF_2)_n$ CONHR, or $F(CF_2)_n$ $CONR_2$, where R is an alkyl group containing from 1 to about 10 carbon atoms, and the corresponding mono or di-amides derived from dicarboxylic acids are $F(CF_2)_n$ COOR where R is an alkyl group containing from 1 to about 10 carbon atoms, and the corresponding mono or diesters derived from dicarboxylic acids. Only perfluoro acids and acid derivatives having a melting point in excess of about 45°C. are intended to be encompassed within the scope of this invention.

Salts of perfluoro acids useful for the purpose of the present invention include generally any of the salts of metals of Groups I, II and VIII of the Periodic Table as well as manganese, lead, strontium and aluminum. Preferred metals are zinc, cadmium, lithium, sodium, calcium, barium; magnesium, manganese, nickel, iron, cobalt, lead and copper. The ammonium salt of the various perfluoro acids may also be used.

Examples of some specific compounds within the scope of the present invention include perfluoro-octanoic acid, zinc perfluoro - stearate, cadmium perfluoro - stearate, perfluoro-octanamide, butyl-perfluoro-laurate, sodium perfluoro-sebacate, perfluoro-azelaic acid and the like.

The above perfluoro compounds may be prepared by any suitable process including the well known Simons process which involves fluorination of the acid by electrolysis of solution of acid in hydrogen fluoride or other fluorine donors. Acid derivatives may be prepared by first forming the perfluoro acid followed by the appropriate conventional reaction of the perfluoro acid to form the desired acid derivative, or by direct fluorination of the acid derivative where possible.

As indicated above, the minimum melting point of the additives should be at least 45°C. or suitably high to prevent melting or agglomeration under machine operating temperatures, which would severely interfere with the required normal flow of the toner and developer material during the electrophotographic process where the cleaning material becomes mixed with toner. Preferably, the additive should have a minimum melting point of about 55°C. to allow for conditions of machine operation and storage where temperature approaching this value might be encountered.

The cleaning material may be applied to the photoreceptor surface by any suitable technique such that a coating is formed on the photoreceptor surface, said coating having a preferred thickness within the range of about 1 A to about 200 A. Thus, the dry solid material may be sprinkled or smeared on the imaging cycle prior to the cleaning station. For example, a suitable dispenser such as a plurality of dispensers described in U.S. Pat. No. 3,013,703 may be positioned over a xerographic drum between the exposure and development stations and be adapted to continously and intermittently sprinkle dry solid particles of the cleaning material on the imaging surface. Another technique would be to apply the material to the imaging surface simultaneously with cleaning. With web cleaning, a fibrous web may be impregnated with small particles of the additive which results in a smearing of the particles on the imaging surface during contact of the web with the surface, as for example disclosed in U.S. Pat. No. 3,664,300. The most expeditious and preferred technique for contacting the cleaning material with the photoreceptor surface is to incorporate it directly into the toner and/or developer as an additive. Following is a more detailed description of the latter preferred embodiment.

Concerning the broad relative proportions of the toner material versus the additive of the present invention, functionally stated, the additive should be present in a proportion at least sufficient to form an adherent deposit substantially uniformly distributed over at least 20% of the area of an imaging surface during cyclic use of the imaging surface. It is preferred that approximately 100% of the imaging area becomes coated or smeared with the additive material. It has been found that from about 0.01 to about 10%, by weight, of the additive based on the weight of the toner material will achieve the foregoing degree of converage. A particularly preferred ratio is from about 0.1 to about 4.0%, by weight, based on the weight of toner.

The toner itself comprises a suitable electroscopic resinous component which preferably is pigmented or dyed. Typical resins which may be employed are materials having a melting or softening point in excess of about 50°C, preferably within the range of about 50° to 150°C. Suitable materials include styrene homopolymers and copolymers; polyesters; polyamides; acrylate and methacrylate polymers; and other materials known in the art such as disclosed in U.S. Pat. Nos. Re.25,136 and 3,079,342. These resins preferably have an average molecular weight within the range of about 2,000 to about 500,000.

The colorant material used in preparing the toner composition may include any pigment or water or organic solvent soluble dye. The most common pigments used in electrostatographic toner materials are finely divided carbon black, cyan, magenta and yellow pigments. The most common dyes are the acid, basic and dispersed dyes of suitable color as are known in the art. Typical examples of suitable colorants are discussed in U.S. Pat. No. 3,502,582. The pigment or dye should be present in the amount effective to render the toner highly colored so that it will form a clearly visible image on a recording member. Preferably, for sufficient color density, the pigment is employed in an amount from about 1 to about 20% by weight, based on the total weight of the colored toner. If the toner colorant employed is a dye, quantities substantially smaller than about 1% by weight may be used.

The toner composition may be fabricated into electrostatographic toner using any of the known techniques of the prior art by mixing the resinous component with a colorant material. Mixing may be accomplished by dispersing the colorant in the melted resin, hardening the resin and pulverizing the composition in a device such as a jet mill or hammermill to form it into small particles. Alternatively, mixing may be carried out by combining the colorant with a solution, dispersion or latex of the resin, followed by recovery of the resin/colorant mixture in finely divided form by spray drying techniques. Suitable methods of mixing are more thoroughly described in U.S. Pat. No. 3,502,582. The average particle size of the processed toner should be within the range of about 1 to 30 microns, preferably between about 3 to 15 microns. A subsequent screening or sizing operation may be necessary to produce a toner having this particle size distribution.

The toner composition may be formulated into an electrostatographic developer composition by combining the finely divided toner with a suitable carrier material such that the toner forms a coating on the carrier. The toner and carrier material may be premixed, or mixed inside the developer region of an electrostatic copy machine. Where the development process is the well known magnetic brush process, the carrier material is a magnetically attractive material such as finely divided iron particles of about 60 to 120 mesh size. For other than magnetic brush development, the carrier material may be of any of the known particulate substances exhibiting appropriate triboelectric effects such that the carrier particles impart a charge to the finer toner whereby the toner adheres to and coats each carrier particle. Examples of suitable carriers are inorganic salts, glass, silicon, steel, and other materials such as disclosed in the aforementioned U.S. Pat. No. 3,502,582. The particle size of the carrier should be significantly greater than the toner, and preferably within the range of about 50 to 1000 microns. The toner is most effectively employed at a level from about 0.5 to about 10 parts by weight per 100 parts by weight of carrier material.

The additive perfluoro acids or acid derivatives of the present invention may be combined with toner or developer by simply dry mixing the additive in finely divided form with the particles of toner such as prepared above, or by dry mixing with developer material which is a premixture of toner and carrier. The particle size of the additive should be less than the particle size of the carrier material, i.e., less than about 500 microns, and may be less than or greater than the particle size of the toner, and preferably within the range of about 0.5 to about 50 microns.

When the developer composition of the present invention is employed for general copying purposes, there may ultimaltely build up an excessive thickness of the additive on the imaging surface. This build up can interfere with effective imaging and development. Experience has shown that the average film thickness should not be permitted to exceed about 200 A. Any effective means can be employed to maintain the build up within the limits indicated. Whatever means is employed, it must not be so effective as to completely remove the additive film or coating. As an approximate lower limit, the means must permit a coating or film having an average thickness of at least about 1 A to remain on the imaging surface. As examples of means effective for this purpose, a cleaning member, e.g., a rotating brush, a web or a wiper blade, may be employed with sufficient force and friction to prevent excessive build up; or the technique of employing a mildly abrasive additive in conjunction with the additive of this invention, as taught in copending application Ser. No. 188,570, filed Oct. 12, 1971 in the names of Don B. Jugle et al. may be employed.

DESCRIPTION OF THE PREFERRED EMBODIMENTS

The following examples further define, describe and compare exemplary methods for preparing and using development system components of the present invention.

EXAMPLE I

The vitreous selenium drum of an automatic copying machine is corona charged to a positive voltage of about 800 volts and exposed to a light-and-shadow image to form an electrostatic latent image. The selenium drum is then rotated through a cascade development station. A control developer is used comprising a mixture of 1 part, by weight, toner containing as the resinous material a styrene-butyl methacrylate copolymer and about 10%, by weight, carbon black and about 100 parts, by weight, of steel core carrier beads. The toner particles have an average particle size of about 10 microns and the carrier beads have an average particle size of about 200 microns. After the electrostatic latent image is developed in the developing station, the resulting toner image is transferred to a sheet of paper at a transfer station. The residual toner particles remaining on the selenium drum after passage through the transfer station are removed by means of a cleaning blade comprising a rectangular strip of about 3/32 inch thick polyurethane elastomer having an edge spring biased against the photoreceptor surface. The trailing face of the cleaning blade is positioned to form an acute angle of about 22° with the line of tangency extending through the line of blade contact. Sufficient pressure is applied to the blade to obtain maximum removal of the toner particles from the drum surface. The drum surface is rotated at a speed of about 10 inches per second past the cleaning blade and 500 copies are made. After only a few copies are made, the copies and drum surface are examined for quality and condition, respectively. The copies made at the start and near the termination of the test are characterized by high background, streak marks, and irregular image density. Large portions of the drum are covered by a continuous toner film and occasional streaks and scratch marks.

EXAMPLE II

The developing procedure of Example I is repeated under substantially the same conditions except that about 1 part, by weight, of perfluoro-octanoic acid particles (available from P.R.C. Inc., of Gainsville, Fla.) having an average particle size of about 25 microns and a melting point of about 53°C. are thoroughly mixed with about 100 parts, by weight, of the toner particles. A fresh vitreous selenium drum is also substituted for the drum employed in Example I. After several thousand copies are made, the copies and xerographic drum surface are examined for quality and condition, respectively. The copies formed throughout the test are characterized by substantially no background toner deposits. The drum surface shows no signs of toner-filming, streaks, or scratches.

EXAMPLE III

The developing procedure of Example II is repeated under substantially the same conditions except that particles of perfluoro-octanamide (available from P.R.C. Inc.) having an average particle size of about 25 microns and a melting point of about 137°C. are substituted for the perfluoro-octanoic acid at the same concentration. The quality of copies obtaned near the termination of the test and the degree of drum degradation observed are substantially the same as that described in Example II.

As previously indicated, the cleaning compounds of the present invention also serve to significantly reduce the frictional forces between photoreceptor sufaces, such as selenium, and cleaning elements which are brought into contact or substantial contact with the photoreceptor surface to remove residual toner therefrom. This is particularly significant where the cleaning element is a blade cleaning device such as disclosed in U.S. Pat. Nos. 3,552,580 and 3,635,704. The significant reduction in frictional forces is best demonstrated by a friction measuring device which embodies a drum having a radius of 4½ inches, the circumferal surface of which is coated with a 60 micron thick layer of vitreous selenium. Comparative coefficient of friction measurements are made by measuring the tangential force exerted on a 1 inch wide rubber wiper blade in contact with the drum surface at the 12 o'clock position as a function of the normal force applied to the blade. The contact angle of the blade is about 27° to the drum tangent at the point of contact in the direction of drum rotation. The blade is counterbalanced for zero normal force and connected to a strain guage with a transducer multiplier for extension of sensitivity. Tests are conducted with a drum velocity of about 0.4 revolutions per second. Developer is applied to the drum surface via a cascade development system at a dark drum density level of about 0.4. The coefficient of friction is obtained by dividing the measured tangential force in grams by the normal force applied to the blade at 10, 20, 30, 40, and 50 grams normal force, and averaging the five values obtained.

Various materials were evaluated for frictional characteristics by blending the material with toner and contacting the toner with an imaging surface. Samples tested include (a) toner without any cleaning additive; (b) toner with 1% by weight polyvinylidene fluoride (Kynar 201 — Penwalt Chemical Corporation); (c) the toner compostion of Example II contaning 1% by weight perfluoro-octanoic acid; and (d) the toner composition of Example II containing 1% by weight perfluoro-octanamide. These compositions were evaluated on the device and according to the procedure outlined above. Friction results are as follows:

| | Average Coefficient of Friction |
|---|---|
| a) Toner alone | 0.94 (N – 10 to 50 gms.) |
| b) Toner + 1% by weight polyvinyl fluoride | 0.85 (N – 10 to 50 gms.) |
| c) Toner + 1% by weight perfluoro-octanoic acid | 0.75 (N – 10 to 50 gms.) |
| d) Toner + 1% by weight perfluoro-octanamide | 0.52 (N – 10 to 50 gms.) |

As seen from the above, cleaning materials encompassed by the present invention offer a significant reduction in the drum coefficient of friction as compared with situations where the drum is not treated or where a fluoride polymer is used as a cleaning aid.

What is claimed is:

1. In an electrophotographic process including the repetitive cycles of placing an electrostatic charge on a photoconductive insulating layer, forming an electrostatic latent image thereon by exposure of said layer to a pattern of light and shadow, developing said latent image by application thereto of a free flowing developer material, and cleaning said layer, the improvement comprising contacting the surface of said photoconductive insulating layer with a material selected from the group consisting of perfluoro-organic acids having from 5 to 26 carbon atoms, salts of said acids, amides of said acids, esters of said acids, and mixtures thereof, said material having a melting point of at least about 45°C, said contacting being sufficient to form a film of the material on said surface.

2. The process of claim 1 wherein said material is in the form of finely divided particles having an average particle size of less than about 500 mircons.

3. The process of claim 1 wherein said cleaning step includes contacting the surface of said photoconductive insulating layer with a wiping member with sufficient pressure to maintain a film of said material having a thickness of at least about 1 A on said surface.

4. An electrophotographic process comprising the steps of placing an electrostatic charge on a photoconductive insulating layer, forming an electrostatic latent image thereon by exposure of said layer to a pattern of light and shadow, developing said latent image by application thereto of a free flowing developer material, transferring said developed image to a transfer member, and cleaning said layer, said developer material comprising a physical mixture of:

a. toner particles comprising a mixture of a resinous material and a colorant, said toner particles having an average particle size of less than about 30 microns; and b. a minor amount of additive particles selected from the group consisting of perfluoro-organic acids having from 5 to 26 carbon atoms, salts of said acids, amides of said acids, esters of said acids, and mixtures thereof, said additive particles having an average particle size of less than about 500 microns and a melting point of at least about 45°C.

5. The process of claim 4 wherein said perfluoro-organic acids are selected from the group consisting of perfluoro-monocarboxylic acids having from 8 to 26 carbon atoms and perfluoro-dicarboxylic acids having from 5 to 26 carbon atoms.

6. The process of claim 5 wherein the additive is perfluoro-octanoic acid.

7. The process of claim 5 wherein the additive is a metal or ammonium salt of said perfluoro-organic acids.

8. The process of claim 5 wherein the additive is an amide of said perfluoro-organic acids.

9. The process of claim 8 wherein the additive is perfluoro-octanamide.

10. The process of claim 5 wherein the additive is an organic ester of said perfluoro-organic acids, the ester group containing from 1 to 10 carbon atoms.

11. The process of claim 5 wherein said additive is present at a level of about 0.1 to 4% by weight of said toner particles.

12. The process of claim 11 wherein said additive has an average particle size within the range of about 0.5 to 50 microns.

13. The process of claim 5 wherein said developer material comprises a mixture of from about 0.5 to 10 parts by weight of toner particles and additive, and about 100 parts by weight of carrier particles, said carrier particles having an average particle size within the range of about 50 to 1000 microns.

* * * * *